United States Patent [19]

Aiello et al.

[11] Patent Number: 4,979,913

[45] Date of Patent: Dec. 25, 1990

[54] ELECTRICAL CONNECTOR WITH HINGED SECONDARY LOCK

[75] Inventors: Richard E. Aiello, Tobaccoville; Christopher L. Allgood, Lewisville; Donald G. Stillie, Winston-Salem; Allan J. Sykora, Kernsersville, all of N.C.

[73] Assignee: AMP Incorporated, Harrisburg, Pa.

[21] Appl. No.: 427,665

[22] Filed: Oct. 26, 1989

[51] Int. Cl.[5] ..... H01R 13/40

[52] U.S. Cl. ..... 439/596; 439/597

[58] Field of Search ..... 439/596, 597, 603

[56] References Cited

U.S. PATENT DOCUMENTS

| | | | |
|---|---|---|---|
| 3,693,134 | 9/1972 | Trevisiol | 339/59 M |
| 3,937,545 | 2/1976 | Cairns et al. | 339/60 R |
| 4,017,141 | 4/1977 | Bury et al. | 339/217 S |
| 4,443,048 | 4/1984 | Moist, Jr. | 339/63 M |
| 4,544,220 | 10/1985 | Aiello et al. | 339/59 M |
| 4,655,525 | 4/1987 | Hunt, III et al. | 339/63 M |
| 4,705,337 | 11/1987 | Maeda | 439/595 |
| 4,708,662 | 11/1987 | Klein | 439/353 |
| 4,711,508 | 12/1987 | Sueyoshi | 439/603 |
| 4,750,893 | 6/1988 | Sueyoshi et al. | 439/596 |
| 4,753,612 | 6/1988 | Betsui | 439/596 |
| 4,754,183 | 6/1988 | Gerber | 310/156 |
| 4,767,361 | 8/1988 | Hoshino et al. | 439/596 |
| 4,787,864 | 11/1988 | Hunt, III et al. | 439/595 |
| 4,867,705 | 9/1989 | Yuasa | 439/596 |

FOREIGN PATENT DOCUMENTS

| | | | |
|---|---|---|---|
| 2062979 | 5/1981 | United Kingdom | 439/596 |

*Primary Examiner*—Paula A. Bradley
*Attorney, Agent, or Firm*—Robert W. Pitts

[57] ABSTRACT

An electrical connector of the type used with lanceless pin and socket terminals includes both a deflectable primary lock and a hinged secondary lock. The deflectable primary lock is in the form of a plurality of outwardly deflectable arcuate members which protrude into housing cavities to engage a continuous locking surface on either a pin or socket when in the undeflected configuration. The hinged secondary lock can be shifted into flush engagement with the exterior of the primary lock only when the primary lock is in the undeflected configuration. The secondary lock thus provides both terminal position assurance, secondary locking and additional locking strength.

21 Claims, 5 Drawing Sheets

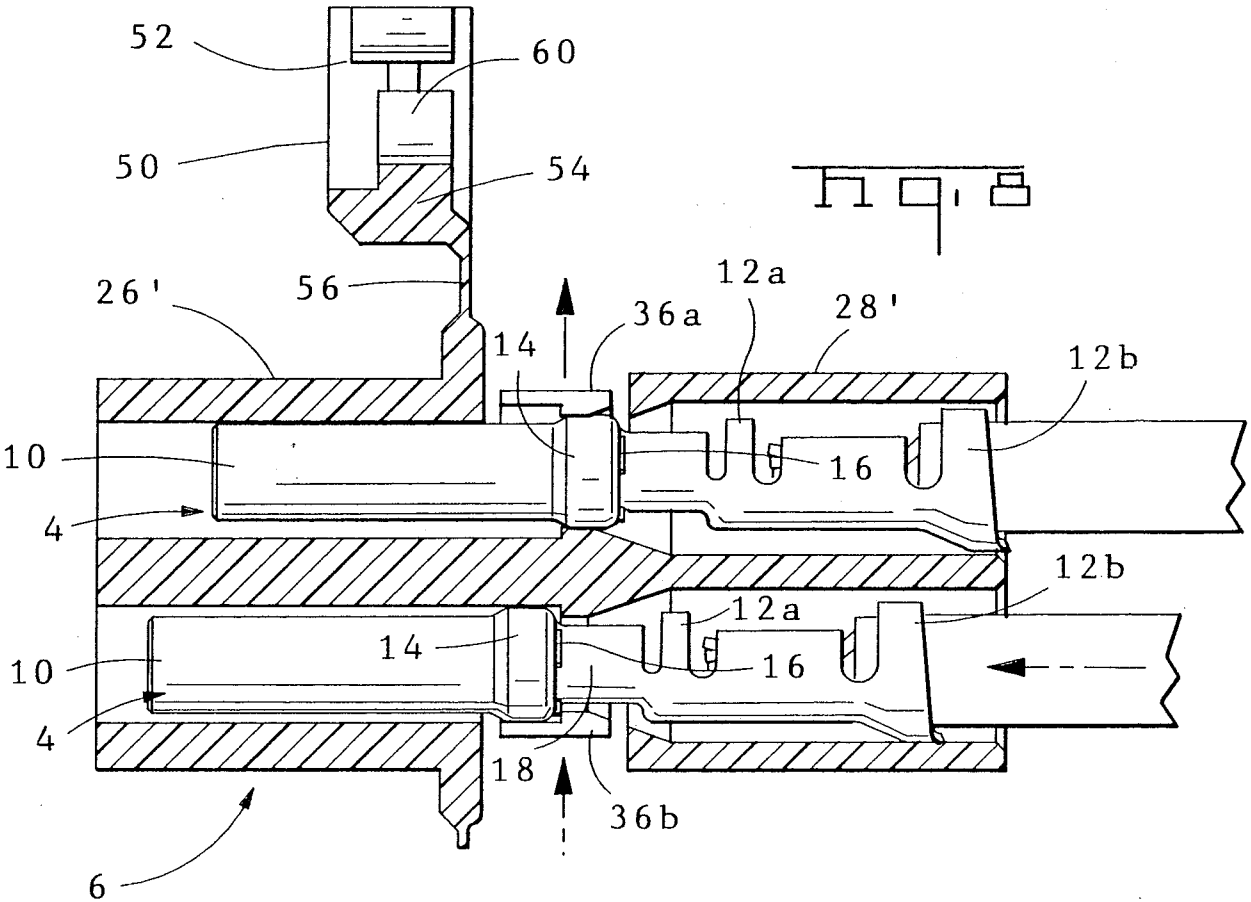
12b
12b
28'
16
12a
12a
16
36a
36b
60
54
14
18
14
56
52
50
26'
10
4
10
4
6

ELECTRICAL CONNECTOR WITH HINGED SECONDARY LOCK

BACKGROUND OF THE INVENTION

1. Field of the Invention

This application relates to an electrical connector employing a plurality of lanceless contacts having both a primary lock and a secondary lock and more particularly relates to a pin and socket electrical connector employing a hinged secondary lock.

2. Description of the Prior Art

Pin and socket connectors employing stamped and formed pin and socket contacts crimped to wires in position with an integrally molded plastic housings have been widely used in computers, business machines, home entertainment apparatus, vending machines, automobiles and other applications. Commercial pin and socket connectors of this type are suitable for assembly by initially crimping individual pin and socket terminals to insulated wires and then inserting a plurality of crimped terminals into integrally molded plastic housings having cavities extending therethrough. U.S. Pat. No. 4,443,048 discloses one such pin and socket electrical connector in which each of the pin and socket contacts has deflectable resilient lances extending outwardly from the periphery thereof.

Although pin and socket connectors having lanced contacts have been generally acceptable to the harness making industry, some problems have been noted because of plastic deformation of the lances, resulting in inadequate assurance that the contacts are retained within cavities in the housings. Problems have also arisen because the lances on the contacts can cause snagging of harness wires. Therefore, lanceless pin and socket contacts retained in the insulative housings by resilient plastic members have been employed. U.S. Pat. Nos. 4,544,220 and 4,708,662 disclose pin and socket electrical connectors having lanceless contacts. Each of these connectors employ at least a two piece housing in which a retainer having flexible plastic latches is inserted in the rear of the contacts. U.S. Pat. No. 3,937,545 discloses an electrical connector employing pin and socket contacts in which plastic latches are incorporated as part of the main body housing. Additional secondary locking members providing back-up to the resilient latches are inserted into the mating faces of connector housings after the contacts have been assembled in respective halves of the connector assembly. Lanceless pin and socket electrical connectors employing a separate retainer or secondary lock member are shown in U.S. Pat. No. 4,787,864. Each of these pin and socket connectors employing lanceless pin and socket contacts employs a resilient housing latch which is cantilevered from one end and employs a inwardly facing protrusion which engages a circumferential recess on the lanceless pin or socket terminal. The use of this inwardly facing protrusion engagable with a circumferential recess means that each of the pin or socket terminals can be inserted into a corresponding cavity within a housing without the necessity of angularly aligning the contact relative to the corresponding cavity.

U.S. Pat. No. 4,655,525 discloses a pin and socket connector in which the connector includes radially expandable arcuate wall sections of housing cavities These arcuate wall sections are outwardly expandable when a terminal is inserted into the appropriate cavity and are free to return to their normal position and grip a recess on the exterior of a cylindrical in or socket terminal. This connector also employs a separate retainer insert which is positioned between parallel rows of cavities and between juxtaposed deflectable arcuate wall sections.

U.S. Pat. Nos. 4,711,508 and 4,750,893 both disclose and electrical connector having a dual housing lock. A first housing latch comprises a resilient member that snaps into an opening in a terminal inserted into the housing and a second lock comprises a hinge member which snaps into engagement with another surface on the terminal. The two housing latching members act independently and are employed with a terminal which must be properly oriented relative to the housing before either of the two independent housing latches will engage the terminal to secure it in place in a housing cavity. Other hinged locking members on insulating housings are shown in U.S. Pat. Nos. 3,693,134, and 4,754,183, and 4,753,612. The device shown in U.S. Pat. 4,753,612 uses both a resilient housing latch and a hinged housing latch which act separately to engage a single terminal, thus providing redundant retention of the single terminal. U.S. Pat. No. 4,017,141 discloses an electrical connector using a pin or socket terminal having lances on the terminal itself to provide primary retention. Secondary retention is provided by a hinged housing member which snaps closed behind a pin or socket terminal inserted into a housing cavity. None of these prior art references, however, disclose an electrical connector employing a one piece housing used with lanceless pin and socket terminals in which the one piece housing includes a first resilient housing latch to engage the lanceless contact terminal and a secondary locking member in the form of a hinged member which engages the resilient housing latch in a closed position and in which the hinged secondary locking member can only be closed if the first resilient locking member is in the fully engaged position. Furthermore, none of these references disclose an electrical connector in which the hinged locking member provides back-up and support for the primary resilient housing locking member.

SUMMARY OF THE INVENTION

An electrical connector, preferably a pin and socket electrical connector employing a plurality of terminals contained within cavities in an insulative housing, includes both a deflectable locking member as part of the housing and a secondary hinged locking member also forming a part of the insulative housing comprises the subject matter of the invention. This electrical connector thus can employ a one piece housing member having a first primary lock and a second hinged lock which can only be closed if the first lock is in an undeflected configuration locking the terminal in position within the housing. The primary locking member is in the form of an outwardly deflectable arch having two resiliently deflectable arcuate sections spaced apart by a gap. The arcs or arches face outwardly so that a hinged secondary lock can be shifted into place on the exterior of the primary locking arches when the primary locking arches are in proper engagement with a terminal in the corresponding cavity.

BRIEF DESCRIPTION OF THE DRAWINGS

FIG. 8 is a sectional view showing various positions of a socket terminal in a receptacle housing.

DETAILED DESCRIPTION OF THE PREFERRED EMBODIMENT

Figure 1B:
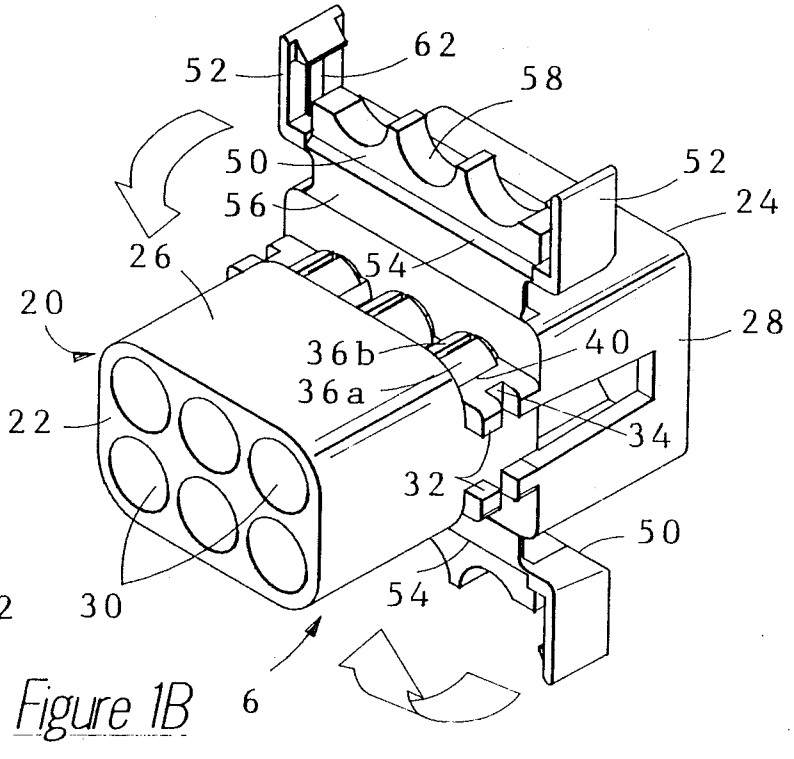
FIGS. 1A and 1B shows two perspective views of a plug housing depicting both the front and rear of the plug housing.
Figure 1A:
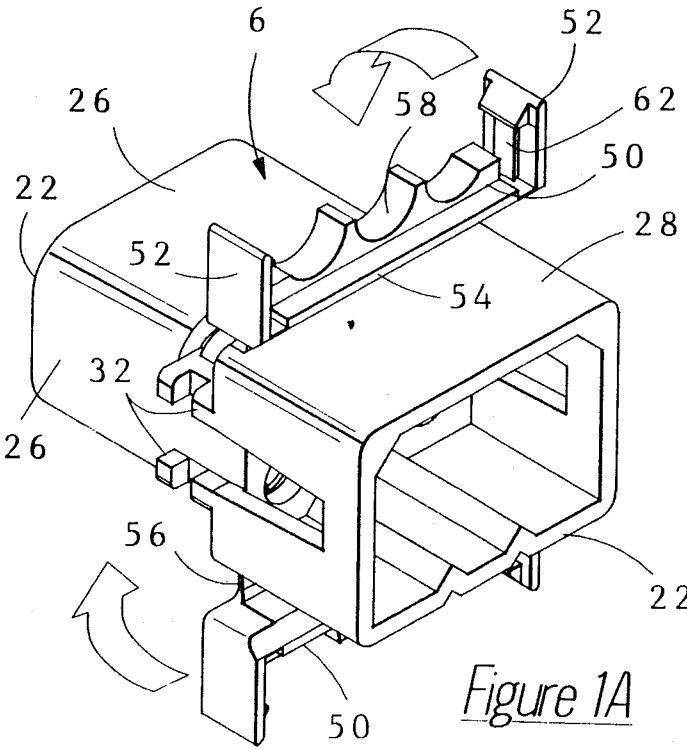
Figure 2:
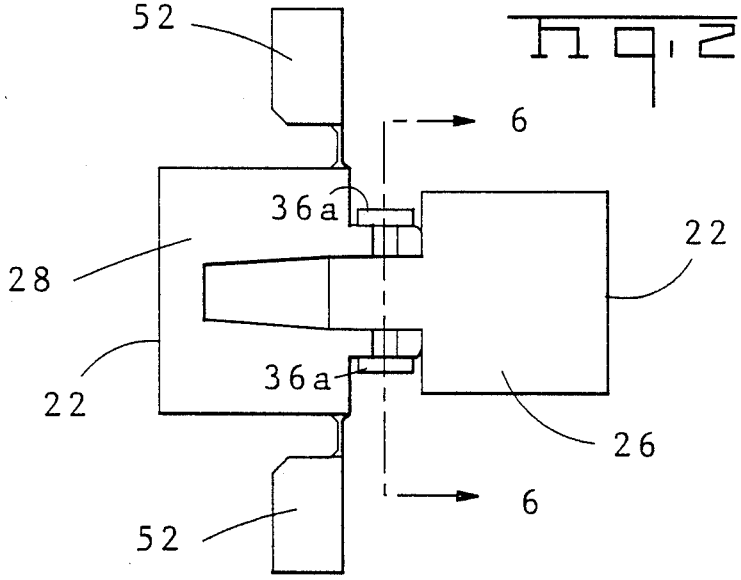
FIG. 2 is a side view of a plug housing.
Figure 3:
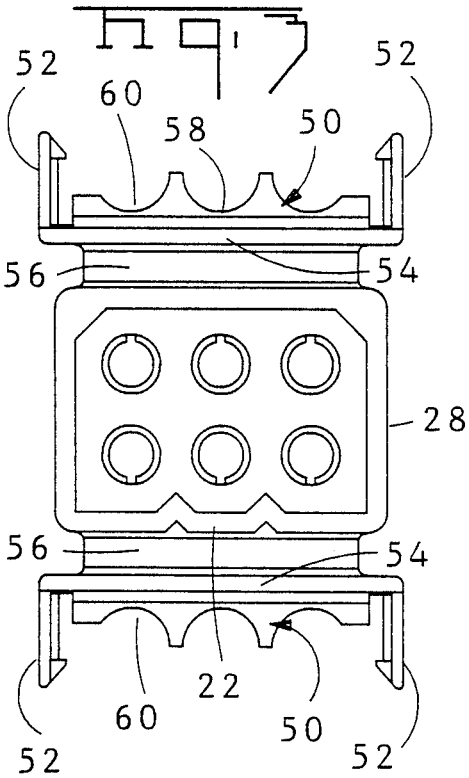
FIG. 3 is a rear view of the insulative housing shown in FIG. 2.
Figure 4:
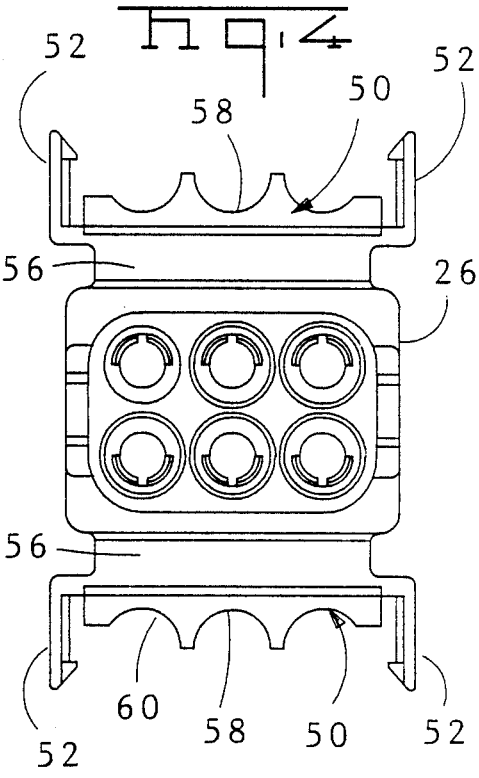
FIG. 4 is a front view of the insulative housing shown in FIG. 2.
Figure 5:
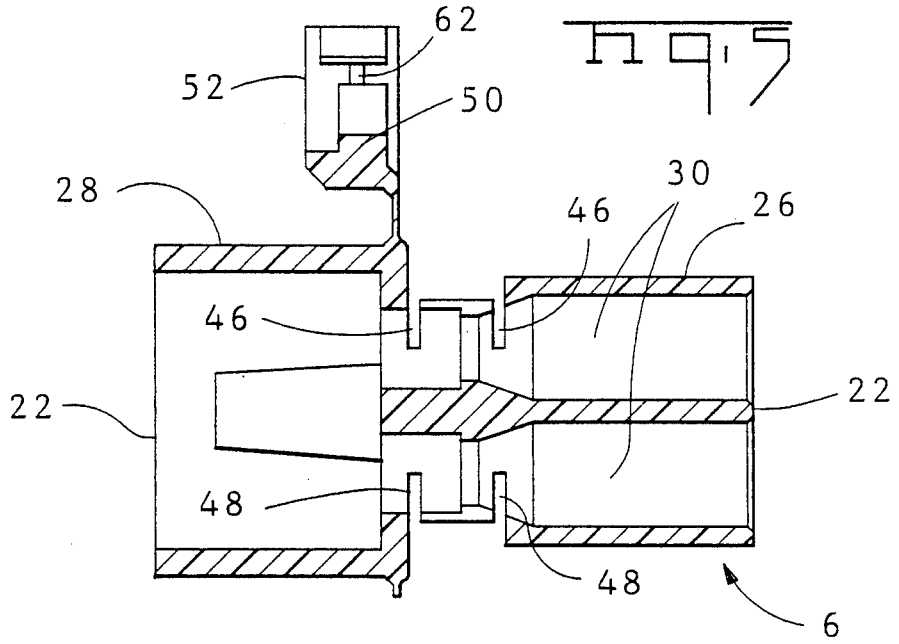
FIG. 5 is a sectional view of the housing shown in FIG. 2.
Figure 6:
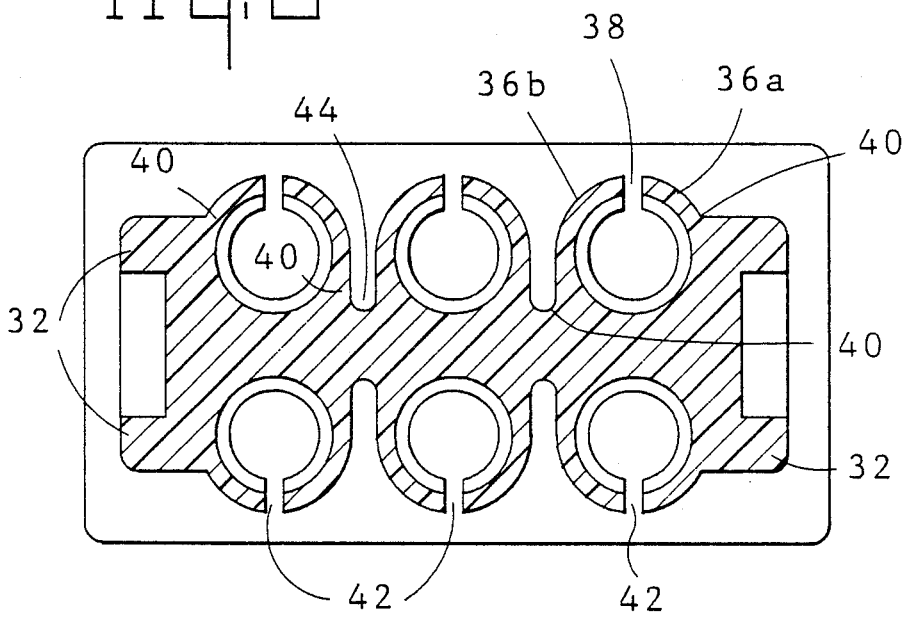
FIG. 6 is a sectional view of the insulative housing taken along section lines 6—6 in FIG. 2.

Plug and receptacle electrical connectors 2 comprising the preferred embodiment of this invention include a plurality of terminals 4 mounted within cavities 30 in an insulative housing. Electrical connector 2 can comprise either a plug housing 6 or a mating receptacle housing (not shown) containing either sockets 4 or cylindrical pins 4'. It should be understood that the pins or sockets can be inserted in either plug or receptacle housings. Plug and receptacle connectors are intermatable in a conventional manner and both plug and the receptacle connector housings employ the same terminal latching mechanism which comprises the subject matter of this invention. For purposes of describing this invention, a plug housing 6 will be described in detail. However, it should be understood that the same invention features can be employed on a receptacle housing and will function in the same manner.

Figures 7A, 7B, 9:
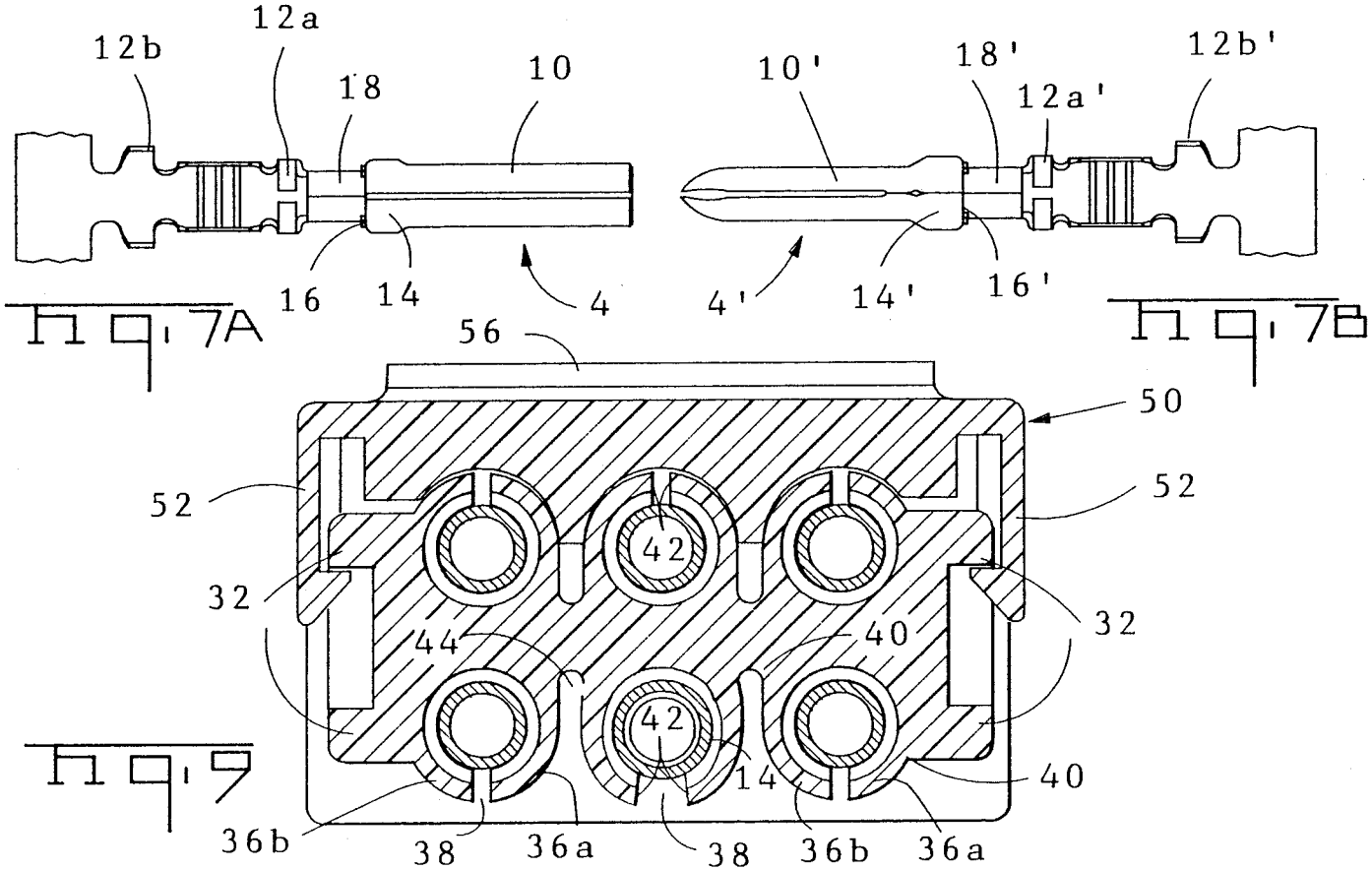
FIG. 7A is a view of the socket contact terminal.
FIG. 7B is a view of the pin contact terminal.
FIG. 9 is a sectional view showing the engagement of the primary resilient latch with a socket terminal fully inserted therein.

The socket terminal 4 shown in FIG. 7A comprises and stamped and formed electrical terminal fabricated of a conventional material. This lanceless socket terminal includes a socket portion 10, and a crimp portion 12 including a conventional wire crimp 12A and a a conventional insulation strain relief crimp portion 12B. Terminal 10 also includes a cylindrical stabilizing rib 14 which has a larger outer diameter than the remainder of the socket portion 10. Stabilizing rib 14 has a shoulder 16 defining the juncture between the stabilizing rib 14 and a circumferential groove 18 located between stabilizing rib 14 and the crimp 12. This groove 18 has an outer diameter less that the outer diameter of the socket portion 10 and less than the outer diameter of the stabilizing rib 14. Since the stabilizing rib 14 extends continuously around the circumference of the terminal 4 and since the groove 18 also extends continuously around the circumference of the terminal, shoulder 16 is circumferentially continuous. Shoulder 16 thus provides a surface on the terminal which can serve as a locking surface permitting a terminal 4 to be inserted into a corresponding cavity in any angular orientation.

Pin terminal 4' includes a pin section 10', a crimp section 12', identical to the crimp portion 12 of the cylindrical socket 4, a stabilizing rib 14', a groove 18' and a locking surface 16' on the exterior of the terminal. Cylindrical pin 4' is matable with cylindrical socket 4 and the retention of both the cylindrical pin 4' and the cylindrical socket 4 in either the receptacle or plug housing is achieved in the same manner.

The insulative plug housing 6 and a matable receptacle housing would be formed of a insulative material of the type commonly used in conventional plug and socket electrical connectors. Significant aspects of this invention can be described with respect to the insulative plug housing 6. Housing 6 includes a body 20 having a plurality of cavities 30. In the preferred embodiment of this invention cavities 30 are located in two rows along opposite sides of the insulative housing 6. Body 20 has a mating end 22 and a rear end 24 and each cavity 30 extends between both ends of the body 20. A mating section 26 is located adjacent the mating end 22 and a conductor receiving section 28 is located adjacent the rear end 24 of the body 20. In the preferred embodiment of this invention the terminals 4 are inserted into the conductor receiving section 28 from the rear end 24 of the housing 6. Each cavity is intended to receive a single terminal 4 and a plurality of cavities 30 are located side by side relationship along each of two outer sides of the housing body 20.

The insulative housing 6 comprises a one piece member and includes a plurality of primary deflectable locks on the exterior of the housing body 20 and a pair of hinged secondary locks 50 also located along the same sides of the body 20 on which the deflectable summary locking means are located. Each deflectable primary lock, including segments 36*a*, 36*b* is in the form of a deflectable arch and is aligned with a corresponding cavity 30. The deflectable arch primary lock which is part of the one piece molded insulative housing 6 is outwardly deflectable. Insertion of a terminal 4 into a cavity 30 from the rear end 24 of the housing will outwardly deflect the segments 36*a*, 36*b* of resilient deflectable primary lock. Each primary lock is in the form of an arch comprising a pair of outwardly deflectable fingers 36*a* and 36*b* which are joined to the insulative housing body 20 along a bend line 40 parallel to the axis to the corresponding cavity 30. Each of the fingers 36*a* and 36*b* has an arcuate configuration. The two outwardly deflectable arcuate fingers or sections 36*a* and 36*b* are located on opposite sides of an axial slit which extends parallel to the axis of the corresponding cavity 30. The free ends 42 of the arcuate fingers define the axial slit 30. The primary locking arch has a curved outer counter in the undeflected configuration and each of the primary locking arches 36*a*, 36 *b* faces outwardly along one side of the insulative housing. In the preferred embodiment of this invention, primary locking arches are located in two rows on oppositely facing sides of the insulative housing body 20. The outwardly deflectable arcuate locking fingers 36*a* and 36*b* are located within a recess 34 extending along the side of the insulative body 20. These recesses 34 extend transversely relative to the access of the cavities 30. The base or bend line 40 along which the fingers 36*a* and 36*b* are joined to the insulative body extends between the axial ends 46 of the fingers. The axial ends 46 of the fingers are however separated from the remainder of the insulative body by gaps 48 located adjacent the edges of the recess 34. Axially extending slots 44 are located between adjacent primary locking arches 36*a*, 36*b* and recess 34. Primary locking finger 36*a* and 36*b* protrudes into the corresponding cavity 32 and engages the locking surface 16 of terminal 4 when the primary locking fingers 36*a* and 36*b* are in the undeflected configuration. Protruding terminal locking section on each deflectable finger thus secures corresponding terminal 4 in its appropriate cavity 30. Each of the deflectable locking fingers 36*a* and 36*b* acts independently to secure the corresponding terminal 4 in its cavity 30. FIG. 9 shows the manner in which the individual locking fingers 36a and 36b deflect outwardly as the stabilizing rib 14 of a terminal passes the locking fingers 36a and 36b during insertion of a terminal.

The deflectable primary locks are each located on an exterior side of the insulative housing body 20. The outer contour of each deflectable locking arch is curved when segments 36a, 36b are in the undeflected configuration. The free ends of the deflectable locking fingers 36a and 36b are outwardly deflectable and thus protrude beyond the outer curved contour defined by the fingers in their undeflected configuration. Although the independently acting primary locks 36 are sufficient to at least initially secure the terminals 4 within their appropriate cavities 30, secondary lock 50 is provided to insure that the terminals 4 remain in position even when subjected to a large retraction force. The secondary lock 50 also acts as a terminal position assurance means since the secondary lock 50 cannot be shifted from an open to a closed position when the primary locking fingers 36a and 36b are outwardly deflected as they would be when terminals 4 are only partially inserted into cavities 30. Each of the secondary locks 50 is hinged relative to the insulative body 20. Hinge 56 is integral with insulative body and the secondary lock 50 is formed as part of the same molding operation in which the insulative body 20 and the deflectable primary lock is formed. Secondary locks 50 are formed on each of the sides of the housing along which outwardly deflectable locking fingers 36a and 36b are located. Secondary lock 50 comprises a bar 54 integral with hinge 56. A plurality of curved sections 58 are formed along the inner contour 60 of the secondary locking bar 54. These curved sections 58 are complementary to the outer contour of the deflectable primary locking arches when the fingers 36a and 36b are in their undeflected configuration. Latches 52 are formed on opposite ends of each secondary locking bar 54 and these latches 52 are engagable with catches 32 on the insulative housing body 20 only when the deflectable primary lock fingers 36a and 36b are in their undeflected configuration in engagement with the locking surface 16 on each corresponding terminal 4. When the secondary locks 50 are latched, rib 62 is received recess 34 on the housing. The secondary locks 50 cannot be latched in a closed position unless the deflectable locking fingers 36a and 36b are in their undeflected configuration. The curved sections 58 are located in side by side relationship on the inner surface of the secondary locking bar 54 in alignment with the plurality of primary locking arches 36a, 36b. If only a single primary locking finger or primary locking arch segment 36a, 36b remains in its outward undeflected configuration, the primary lock will prevent the secondary lock 50 from latching in the closed position. Each secondary locking bar 50 extends transversely relative to all of the cavities 30 located on that side and the secondary locking bar resides at least partially in the recess 34 located along that side of the housing. The secondary locks 50 are thus hinged relative to the insulative body so they can be shifted inwardly from an open position to a closed position in which the secondary locking bar 54 is received within recess 34 and in which the curved sections 58 are in flush engagement with the curved exterior of the arches segments 36a, 36b when all terminals 4 are properly secured within the housing 6. In the fully closed position the latches 52 on the secondary locks 50 engage a catch surface 32 located on the ends of the insulative housings. In this latched configuration with the secondary lock 50 in the closed position, these curved sections 58 in flush engagement with the curved exterior of the primary locking arch segments 36a, 36b, serve to back up the primary locks 36a, 36 b and provide additional strength to the locking system. Thus, greater retraction forces can be withstood.

The primary and secondary locking members employed on the preferred embodiment of this invention can easily be employed on both the plug or receptacle connector and with either pin or socket terminals. A one piece housing having locking means engagable with lanceless cylindrical pin and socket contacts is thus provided. An assembler can be assured that individual terminals are properly secured within the housings because the secondary locks will not close when the terminal is partially inserted. Although it would be possible to close the secondary lock during the initial insertion of the terminal and prior to the time the terminal is locked within the housing, the terminals are long enough to protrude beyond the rear of the housing and an assembly can easily detect such a condition. Furthermore, the terminals in this initial position would be easily retractable from the housing. When the terminal is fully inserted, it will be retained in its initial position prior to the time the secondary lock is closed. Thus, both initial primary retention followed by further backup secondary locking engagement can be provided with a one piece housing and an assembler would not be required to use a separate locking piece to provide both secondary locking and terminal position assurance.

What is claimed is:

1. An electrical connector comprising: at least one terminal having a locking surface on the exterior of the terminal;

an insulative housing including a body having at least one cavity in which one of the terminals is received;

the electrical connector being characterized in that the insulative housing includes;

deflectable locking means on one side of the insulative housing body, the deflectable locking means protruding into a corresponding cavity and engaging the locking surface on the terminal when in an undeflected configuration, and secondary locking means hinged relative to the insulative housing body and shiftable from an open position to a closed position, the secondary locking means including latch means engageable with the insulative housing body when the deflectable locking means is in engagement with the locking surface on each corresponding terminal in the undeflected configuration; the deflectable locking means, when outwardly deflected, engaging the secondary locking means to prevent the secondary locking means from engaging the insulative housing, whereby the secondary locking means cannot be latched in the closed position unless the deflectable locking means is in the undeflected configuration.

2. The electrical connector of claim 1 wherein the secondary locking means engages the deflectable locking means to prevent the movement of the deflectable locking means from the undeflected configuration.

3. The electrical connector of claim 2 wherein the outer contour of the deflectable locking means is complementary to the inner contour of the secondary locking means when the deflectable locking means is in the undeflected configuration so that the interior surface of the secondary locking means can be positioned flush with the exterior surface of the deflectable locking means when the deflectable locking means is in the undeflected configuration.

4. The electrical connector of claim 3 wherein the locking surface extends circumferentially around the terminal so that the terminal can be inserted into a corresponding cavity in any angular orientation.

5. The electrical connector of claim 4 wherein the terminal is a cylindrical socket.

6. The electrical connector of claim 4 wherein the terminal is a cylindrical pin.

7. The electrical connector of claim 6 wherein the insulative housing body has a plurality of side-by-side cavities, the deflectable locking means for all of the cavities being on an exterior side of the insulative housing body, the secondary locking means comprising a single member engagable with all of the deflectable locking means so that the secondary locking means cannot be latched in the closed position if any one of the deflectable locking means is in the undeflected configuration.

8. The electrical connector of claim 7 wherein each deflectable locking means comprises a pair of outwardly deflectable fingers.

9. The electrical connector of claim 8 wherein each pair of outwardly deflectable fingers is joined to the insulative housing body along a bend line parallel to the axis of the corresponding cavity, the free ends of each of the deflectable fingers being radially outwardly deflectable relative to the bend lines and the axis of the corresponding cavity.

10. The electrical connector of claim 9 wherein each of the outwardly deflectable fingers has an arcuate configuration.

11. An electrical connector comprising a plurality of terminals positioned within cavities in a one-piece insulative housing wherein the housing includes a deflectable arch aligned with each cavity, each arch protruding inwardly for engagement with a corresponding terminal when in an undeflected configuration, the insulative housing further including a secondary lock shiftable between an open and a closed position, each arch engaging the secondary lock to prevent the secondary lock from moving to the closed position when one arch is outwardly deflected.

12. The electrical connector of claim 2 wherein the secondary lock is connected to the insulative housing by a hinge, the secondary lock comprising a part of a one piece insulative housing also including the aches.

13. The electrical connector of claim 11 wherein the outer surface of each arch is curved in the undeflected configuration, and the secondary lock has curved sections which fit over the curved arches.

14. The electrical connector of claim 13 wherein the secondary lock comprises a bar extending laterally relative to the cavities in the insulative housing and the curved sections are located on the bar in alignment with the arches.

15. The electrical connector of claim 14 wherein the bar includes a latch on each end, the latch being engagable with a catch on the on the insulative housing when the secondary lock is in the closed position.

16. The electrical connector of claim 15 wherein the arches face outwardly on at least one side of the insulative housing.

17. The electrical connector of claim 16 wherein the insulative housing has two rows of cavities, the arches facing outwardly on two opposite sides of the insulative housing.

18. The electrical connector of claim 17 wherein each arch comprises two outwardly deflectable arcuate sections on opposite sides of a slit, each slit extending parallel with the axis of the corresponding cavity.

19. The electrical connector of claim 18 wherein each arcuate section has a base joining the insulative housing on the periphery of a corresponding cavity.

20. The electrical connector of claim 19 wherein the arches are located in a recess extending transversely relative to the cavities, the secondary lock residing at least partially in the recess when in the closed position.

21. An electrical connector comprising a plurality of terminals positioned within cavities in an insulative housing wherein the housing comprises a one piece molded member including an insulative housing body, an outwardly deflectable primary lock aligned with each cavity and a secondary lock, each primary lock protruding in a corresponding cavity to secure the corresponding terminal in the corresponding cavity when in an undeflected configuration, the secondary lock being hinged relative to the insulative housing body and being shiftable between an open and a closed position, the secondary lock backing up the primary lock in the closed position, a latch on the secondary lock engaging the insulative housing body when the secondary lock is in the closed position, each primary lock engaging the secondary lock to prevent the secondary lock from latching in the closed position when one primary lock is outwardly deflected.

* * * * *